US005911096A

United States Patent [19]

Batori et al.

[11] Patent Number: 5,911,096

[45] Date of Patent: Jun. 8, 1999

[54] IMAGE FORMING APPARATUS ON WHICH A PROCESS CARTRIDGE IS DETACHABLY MOUNTED AND A PROCESS CARTRIDGE DETACHABLY MOUNTABLE TO A MAIN BODY OF AN IMAGE FORMING APPARATUS INCLUDING A GRIP PORTION

[75] Inventors: Yoshiyuki Batori; Minoru Sato, both of Toride, Japan

[73] Assignee: Canon Kabushiki Kaisha, Tokyo, Japan

[21] Appl. No.: 09/024,262

[22] Filed: Feb. 17, 1998

[30] Foreign Application Priority Data

Feb. 17, 1997 [JP] Japan ..... 9-048493

[51] Int. Cl.[6] ..... G03G 21/16

[52] U.S. Cl. ..... 399/111

[58] Field of Search ..... 399/111, 114, 399/125

[56] References Cited

U.S. PATENT DOCUMENTS 5,066,976 11/1991 Kanagawa et al. ..... 399/111
5,331,373 7/1994 Nomura et al. ..... 399/111
5,500,714 3/1996 Yashiro et al. ..... 399/111
5,617,579 4/1997 Yashiro et al. ..... 399/114
5,689,774 11/1997 Shishido et al. ..... 399/111
5,708,922 1/1998 Azuma et al. ..... 399/111
5,729,796 3/1998 Miura et al. ..... 399/114

*Primary Examiner*—S. Lee
*Attorney, Agent, or Firm*—Fitzpatrick, Cella, Harper & Scinto

[57] ABSTRACT

A process cartridge detachably mountable to a main body of an electrophotographic image forming apparatus includes an electrophotographic photosensitive member, a process device acting on the photosensitive member, a cartridge frame having a grip portion to be gripped when the process cartridge is mounted to and dismounted from the main body of the image forming apparatus, and first and second concave portions provided on the cartridge frame at one side and other side of the grip portion in a longitudinal direction of the cartridge frame and being concave toward the interior of the process cartridge.

18 Claims, 20 Drawing Sheets

FIG. 18

| | | PROCESS CARTRIDGE | |
|---|---|---|---|
| | | B | D |
| IMAGE FORMING APPARATUS | A | ○ | ○ |
| | C | × | ○ |

FIG. 21

| | | PROCESS CARTRIDGE | | | |
|---|---|---|---|---|---|
| | | BLACK | CYAN | MAGENTA | YELLOW |
| IMAGE FORMING APPARATUS | BLACK | ○ | × | × | × |
| | CYAN | × | ○ | × | × |
| | MAGENTA | × | × | ○ | × |
| | YELLOW | × | × | × | ○ |

IMAGE FORMING APPARATUS ON WHICH A PROCESS CARTRIDGE IS DETACHABLY MOUNTED AND A PROCESS CARTRIDGE DETACHABLY MOUNTABLE TO A MAIN BODY OF AN IMAGE FORMING APPARATUS INCLUDING A GRIP PORTION

BACKGROUND OF THE INVENTION

1. Field of the Invention

The present invention relates to a process cartridge and an electrophotographic image forming apparatus.

The "electrophotographic image forming apparatus" is an apparatus for forming an image on a recording medium by using an electrophotographic image forming apparatus. For example, the electrophotographic image forming apparatus may be an electrophotographic copying machine, an electrophotographic printer (for example, a laser beam printer or an LED printer), an electrophotographic facsimile or an electrophotographic word processor. The "process cartridge" incorporates therein an electrophotographic photosensitive member and at least one of a charge means, a developing means, and a cleaning means as a cartridge unit which can detachably be mounted to a main body of an electrophotographic image forming apparatus.

2. Related Background Art

A conventional electrophotographic image forming apparatus, such as an electrophotographic copying machine, a laser beam printers or the like includes a photosensitive drum. Well-known processes such as charging, exposure and development are successively effected regarding the photosensitive drum to thereby form a toner image on the photosensitive drum and transfer the toner image onto a recording medium. Thereafter, residual toner remaining on the photosensitive drum is removed by a cleaning device. In this way, the image is formed.

In such electrophotographic image forming apparatuses, recently, a process cartridge has been adopted to make the apparatus compact and simplify maintenance. In the process cartridge, the photosensitive drum and the process means (such as a charge member, a developing member and a cleaning member) acting on the photosensitive drum are integrally incorporated as a cartridge unit, which can detachably be mounted to a main body of the image forming apparatus by an operator himself.

Such a process cartridge has a grip through which the operator mounts the process cartridge to the main body of the image forming apparatus by his hand.

SUMMARY OF THE INVENTION

An object of the present invention is to provide a process cartridge which can positively be mounted to a main body of an image forming apparatus, and an electrophotographic image forming apparatus to which such a process cartridge can detachably be mounted.

Another object of the present invention is to provide a process cartridge in which a grip can easily be recognized by an operator, and an electrophotographic image forming apparatus to which such a process cartridge can detachably be mounted.

A further object of the present invention is to prevent a process cartridge from being erroneously mounted to a main body of an image forming apparatus by an operator.

Another object of the present invention is to provide a process cartridge detachably mountable to an electrophotographic image forming apparatus, comprising an electrophotographic photosensitive member, process means acting on the electrophotographic photosensitive member, a cartridge frame, a grip portion to be gripped when the process cartridge is mounted to and dismounted from a main body of the electrophotographic image forming apparatus, a first concave portion provided on the cartridge frame at one side of the grip portion in a longitudinal direction of the cartridge frame and being concave toward the interior of the process cartridge, and a second concave portion provided on the cartridge frame at the other side of the grip portion opposite to the above-mentioned one side in the longitudinal direction of the cartridge frame and being concave toward the interior of the process cartridge.

The other objects and features of the present invention will be apparent from the following detailed explanation referring to the accompanying drawings.

BRIEF DESCRIPTION OF THE DRAWINGS

FIG. 18 is a view showing results of the combination of the image forming apparatus A, C and the process cartridge B, D;

FIG. 21 is a view showing results of four combinations of the image forming apparatus and the process cartridge.

DETAILED DESCRIPTION OF THE PREFERRED EMBODIMENTS

The present invention will now be fully explained in connection with embodiments thereof with reference to the accompanying drawings. In the following explanation, regarding various elements, a horizontal direction perpendicular to a mounting and dismounting direction of a process cartridge with respect to an image forming apparatus is referred to as a "longitudinal direction".

(First Embodiment)

Now, a process cartridge and an image forming apparatus to which such a process cartridge can detachably be mounted will be fully explained with reference to FIGS. 1 to 12.

First of all, the entire constructions of the process cartridge and the image forming apparatus using such a process cartridge will be explained.

(Entire Construction)

Figure 3:
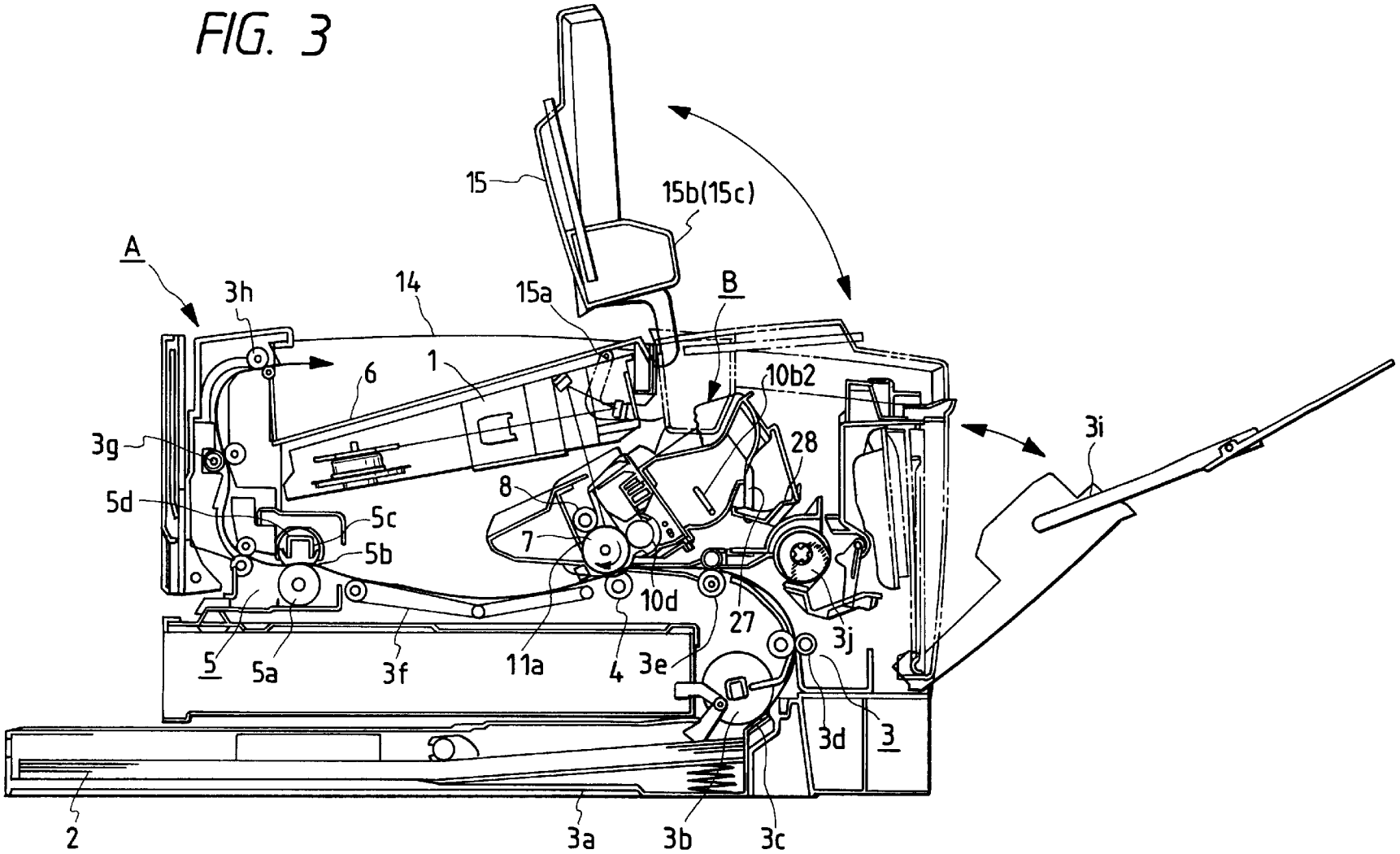
FIG. 3 is an elevational sectional view of an image forming apparatus and the process cartridge.

As shown in FIG. 3, in an electrophotographic image forming apparatus (laser beam printer) A, a latent image is formed on a drum-shaped electrophotographic photosensitive member 7 by projecting information light corresponding to image information from an optical system 1 onto the photosensitive member 7, and then the latent image is developed with developer (referred to as "toner" hereinafter) to form a toner image. In synchronism with the formation of the toner image, recording media 2 are separated and supplied, one-by-one from a sheet supply cassette 3*a* by means of a pick-up roller 3*b* and urging member 3*c* urged against the pick-up roller. The separated recording medium 2 is conveyed by a convey means 3 comprised of a pair of convey rollers 3*d* and a pair of regist rollers 3*e*. Then, the toner image formed on the photosensitive member 7 of a process cartridge B is transferred onto the recording medium 2 by applying voltage to a transfer roller (transfer means) 4.

Thereafter, the recording medium 2 is sent to a fixing means 5 through a convey belt 3*f*. The fixing means 5 includes a drive roller 5*a*, and a fixing rotary member 5*d* formed from a cylindrical sheet having a heater 5*a* therein and rotatably supported by a support 5*c*. While the recording medium 2 is passing between the roller 5*a* and the fixing rotary member 5*d*, heat and pressure are applied to the recording medium to thereby fix the toner image to the recording medium. Thereafter, the recording medium 2 is conveyed through a reverse rotation path by means of pairs of discharge rollers 3*g*, 3*h* and is discharged onto a discharge tray 6. Incidentally, in the image forming apparatus A, manual sheet insertion supply can be permitted by providing a manual insertion tray 3*i* and a manual insertion roller 3*j*.

(Process Cartridge)

Figure 4:
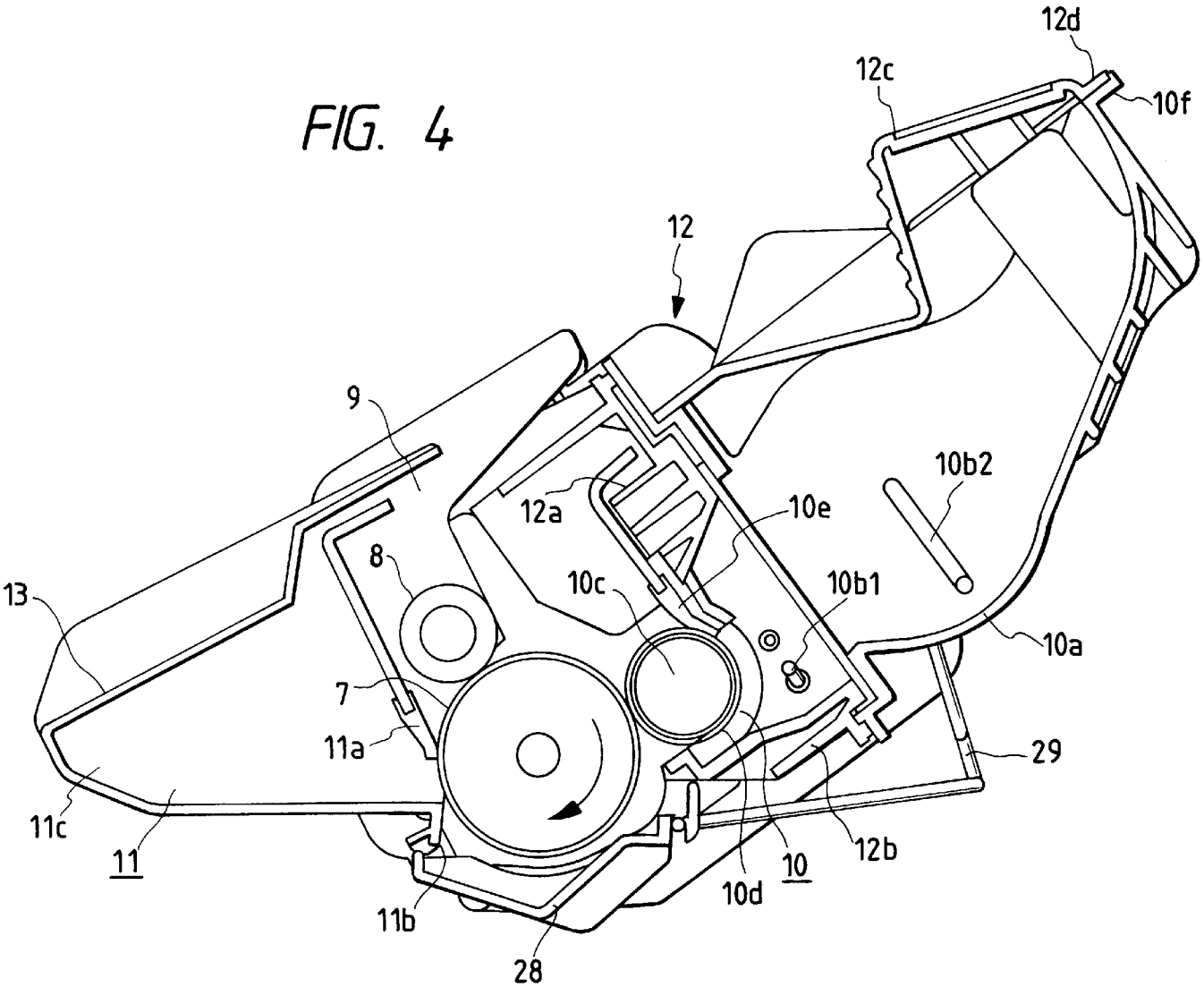
FIG. 4 is an elevational sectional view of the process cartridge.

The process cartridge B includes the electrophotographic photosensitive member and at least one process means. The process means may be, for example, a charge means for charging the electrophotographic photosensitive member, a developing means for developing a latent image formed on the electrophotographic photosensitive member and/or a cleaning means for removing the residual toner remaining on the electrophotographic photosensitive member. As shown in FIG. 4, in the process cartridge B according to the illustrated embodiment, the photosensitive drum (electrophotographic photosensitive member) 7 having a photosensitive layer is rotated and is uniformly charged by applying voltage to a charge roller (charge means) 8. Then, a latent image is formed by illuminating the photosensitive drum with the image light from the optical system 1 through an opening portion 9, and the latent image is developed by a developing means 10.

In the developing means 10, the toner contained in a toner containing portion 10*a* is sent by means of rotatable first and second toner feed members (toner feed member) 10*b*1, 10*b*2 disposed within the toner containing portion 10*a*. While a developing roller (developing rotary member) 10*d*, having a fixed magnet 10*c* therein, is being rotated, a toner layer is formed on a surface of the developing roller 10*d* by applying frictional charge by means of a developing blade 10*e*, and the toner on the toner layer is transferred onto the latent image on the photosensitive drum 7 to thereby form a toner image.

The toner image is transferred onto the recording medium 2 by applying voltage having a polarity opposite to that of the toner image to the transfer roller 4. Thereafter, residual toner remaining on the photosensitive drum 7 is removed by a cleaning means 11 comprising a cleaning blade 11*a* for scraping the residual toner on the photosensitive drum, a dip sheet 11*b* for receiving the scraped toner and a waste toner containing portion 11*c* for collecting the waste toner.

At a contact area between the photosensitive drum 7 and the transfer roller 4, an opening portion is formed in a cartridge frame, and this opening portion is closed by a shutter 28. The shutter 28 constitutes a quadric link mechanism having the cartridge frame as a fixed node and is supported by a link member 29 and an arm member (another link) (FIGS. 1 and 8 to 12).

Various members such as the photosensitive drum 7 are contained in the cartridge frame as a unit which can detachably be mounted to a cartridge mounting means of a main body 14 of the image forming apparatus. The cartridge frame is formed by joining a toner developing frame 12 (obtained by welding together an upper developing frame 12*a*, a lower developing frame 12*b*, the toner containing portion 10*a* and a lid member 12*c*) and a cleaning frame 13 forming a cleaning container.

<Mounting and Dismounting of Process Cartridge>

Now, an arrangement for mounting and dismounting the process cartridge with respect to the main body 14 of the image forming apparatus will be explained.

Figure 5:
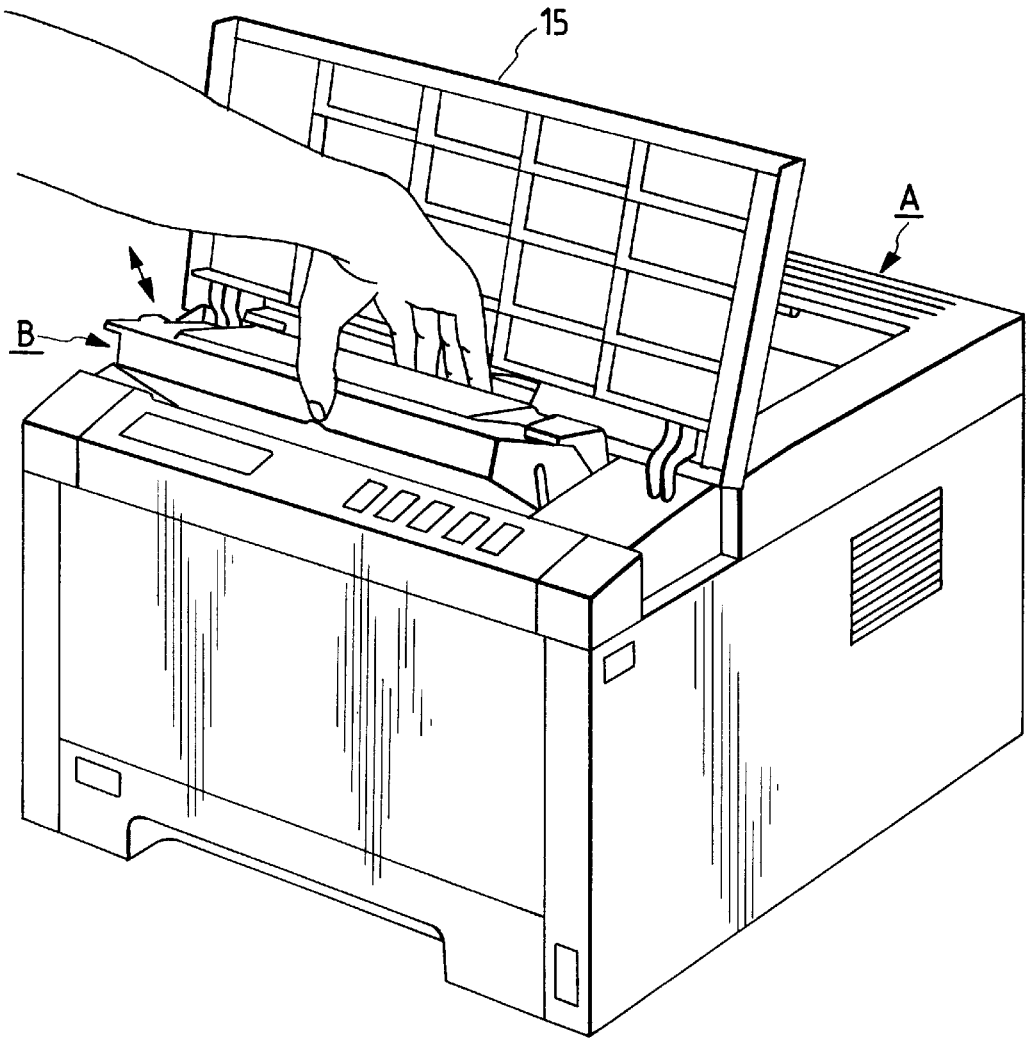
FIG. 5 is a perspective view of the image forming apparatus to which the process cartridge is detachably mounted.
Figure 6:
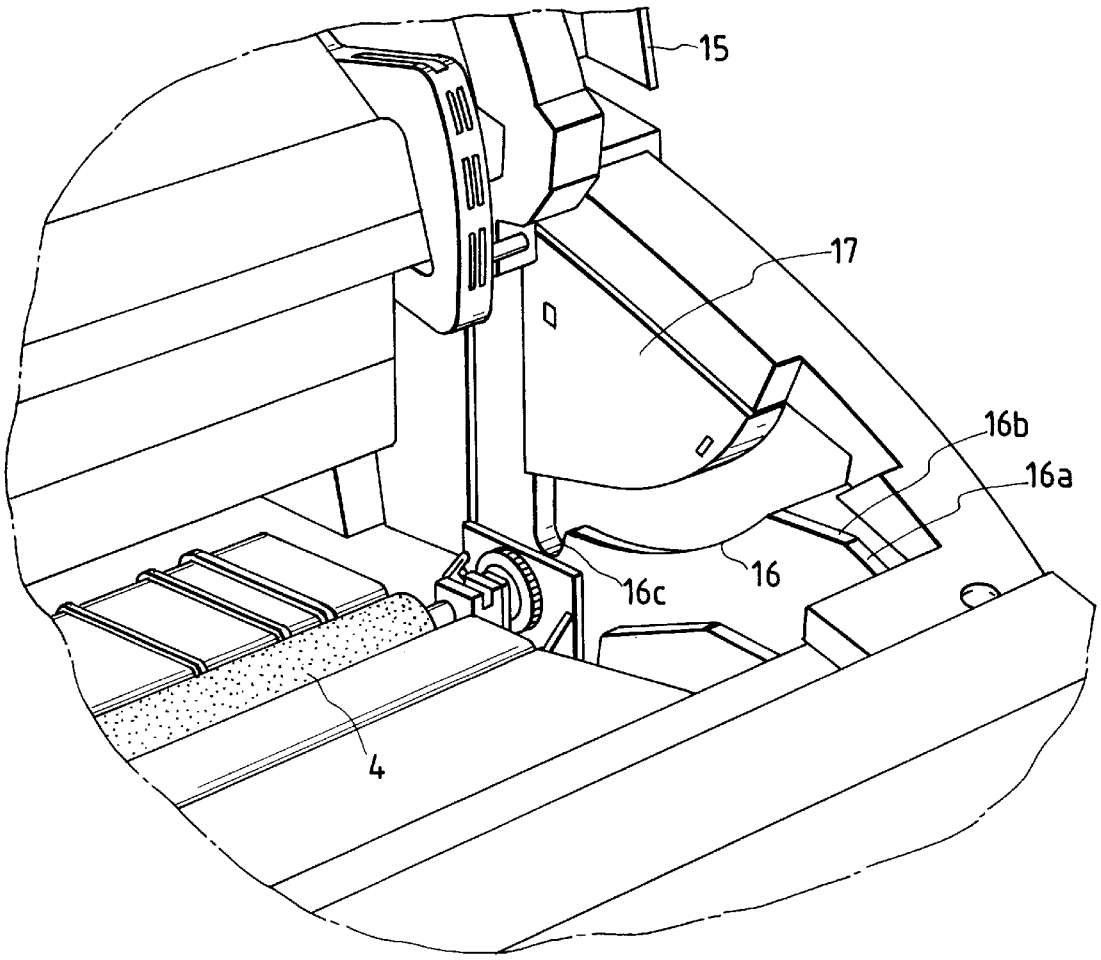
FIG. 6 is a perspective view of a right guide of the image forming apparatus for guiding the mounting and dismounting of the process cartridge.
Figure 7:
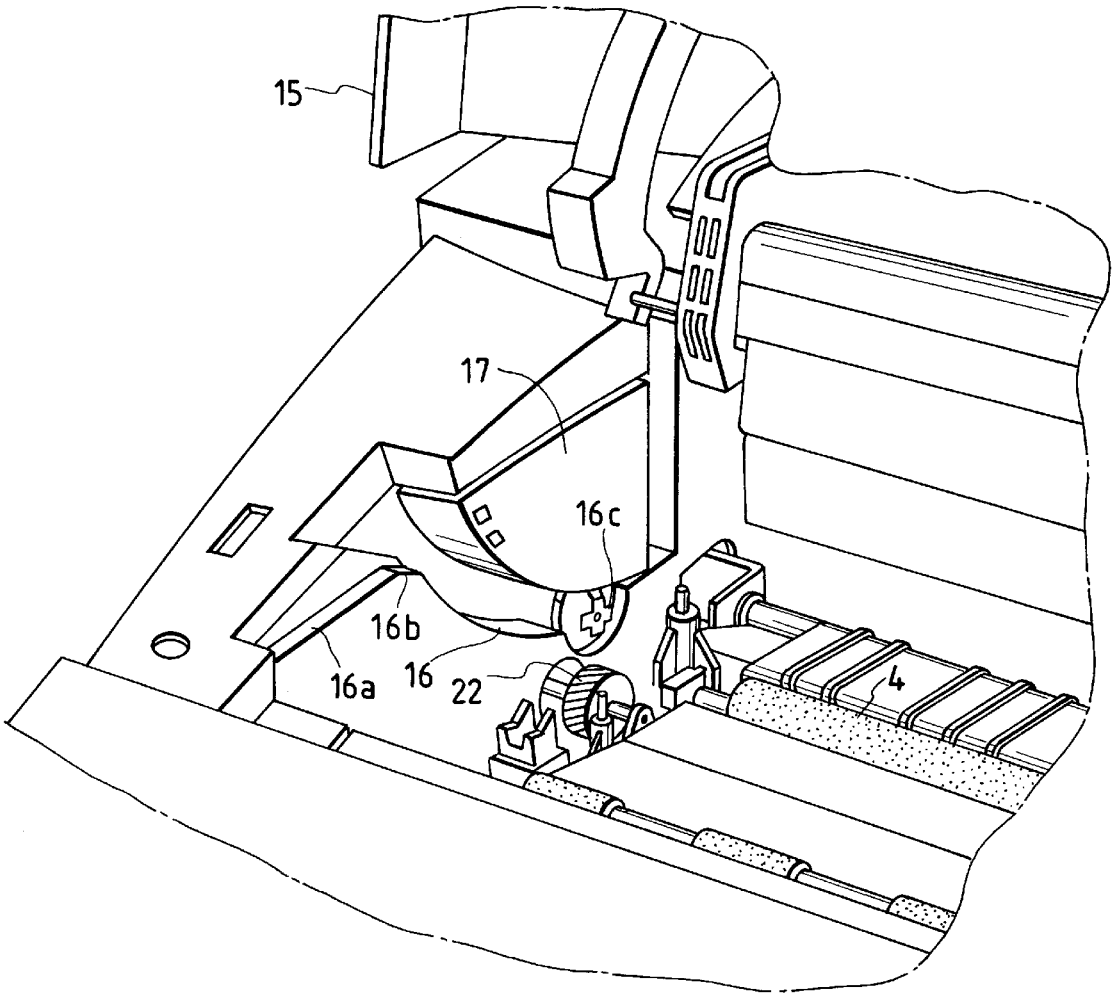
FIG. 7 is a perspective view of a left guide of the image forming apparatus for guiding the mounting and dismounting of the process cartridge.
Figure 8:
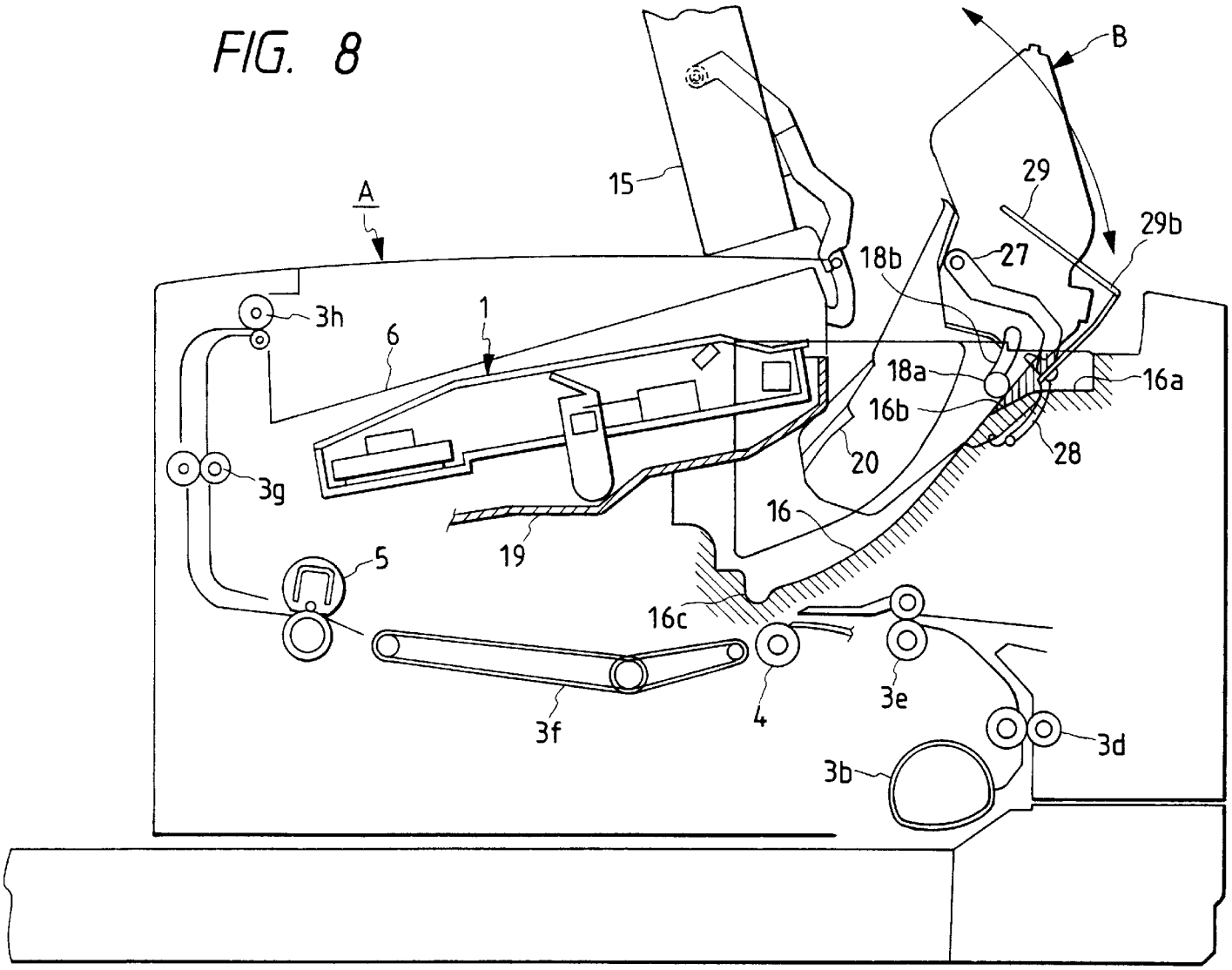
FIGS. 8, 9, 10, 11 and 12 are explanatory views for explaining the mounting and dismounting of the process cartridge with respect to the image forming apparatus.

The mounting and dismounting of the process cartridge B is effected after an open/close member 15 is opened as shown in FIG. 5. When the open/close member 15 is opened around a shaft 15*a* (FIG. 3), a space of the cartridge mounting portion is exposed. As shown in FIGS. 6 and 7, curved (arc in the illustrated embodiment) guide rails 16 extending forwardly and downwardly and concave downwardly are symmetrically disposed on both sides of the cartridge mounting space. Guide members 17 are provided above the guide rails. Further, each guide 16 is provided at its entrance portion with a first inclined surface 16*a* (as a hooked portion) with which a protruded portion 29*b* of the link member 29 provided for opening and closing the shutter 28 of the process cartridge B, and a second inclined surface 16*b* contiguous with the first inclined surface 16*a* and having an inclination greater than that of the first inclined surface.

Figure 1:
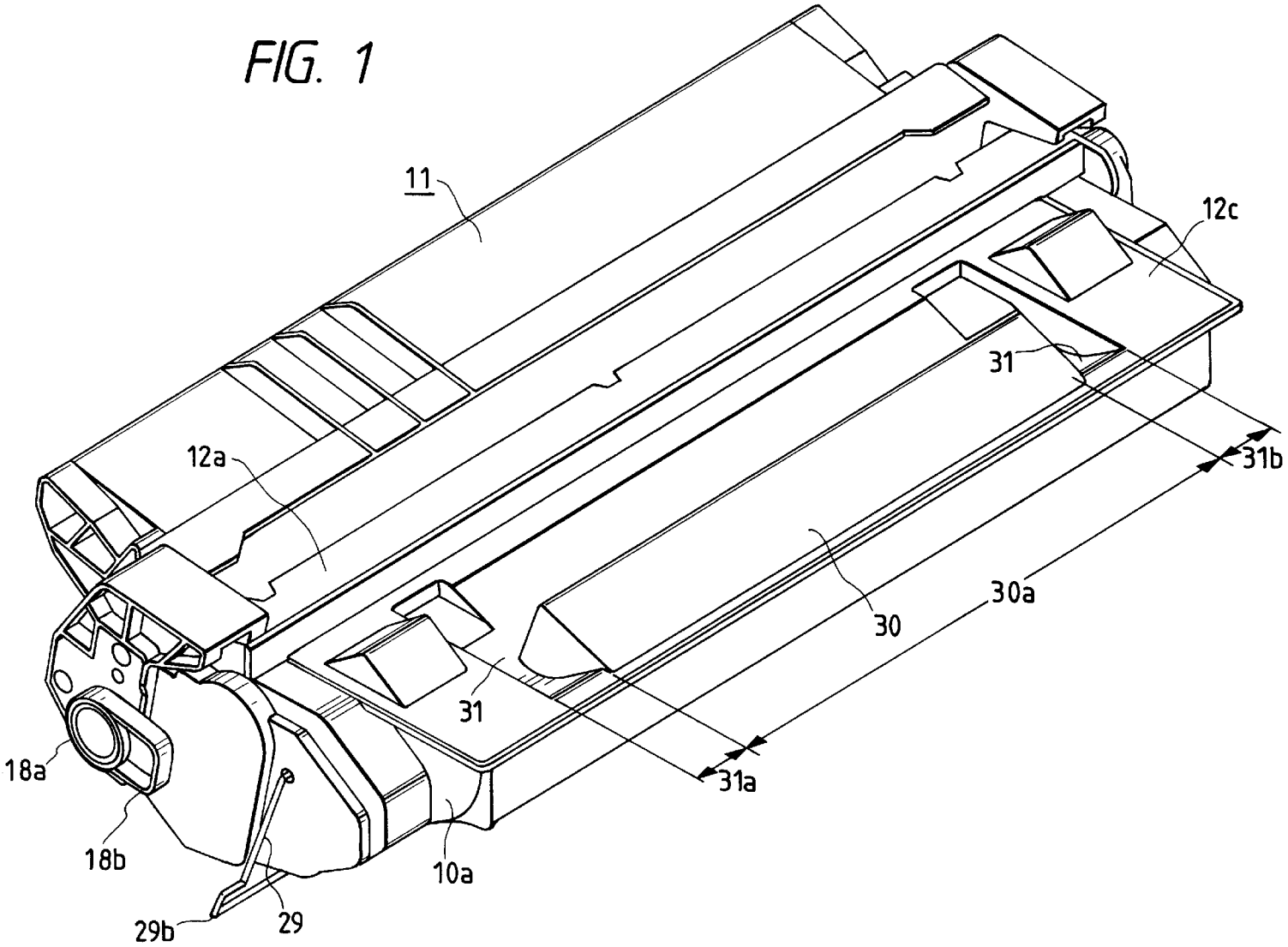
FIG. 1 is a perspective view showing a left side surface of a process cartridge according to a preferred embodiment of the present invention.

On the other hand, the process cartridge is provided at its both side surfaces (in the longitudinal direction) with guide portions corresponding to the guide rails 16. The guide portions are symmetrically protruded outwardly from the side surfaces of the cartridge frame in the longitudinal direction. As shown in FIG. 1, each guide portion has a boss (first guide portion) 18*a* and a rib (second guide portion) 18*b*. The bosses 18*a* are disposed on a line passing through a rotation axis of the photosensitive drum 7, and each rib 18*b* is contiguous with the corresponding boss 18*a* and extends rearwardly in an inserting direction of the process cartridge B and has a curved (arc in the illustrated embodiment) configuration corresponding to the corresponding guide rail 16.

Figure 9:
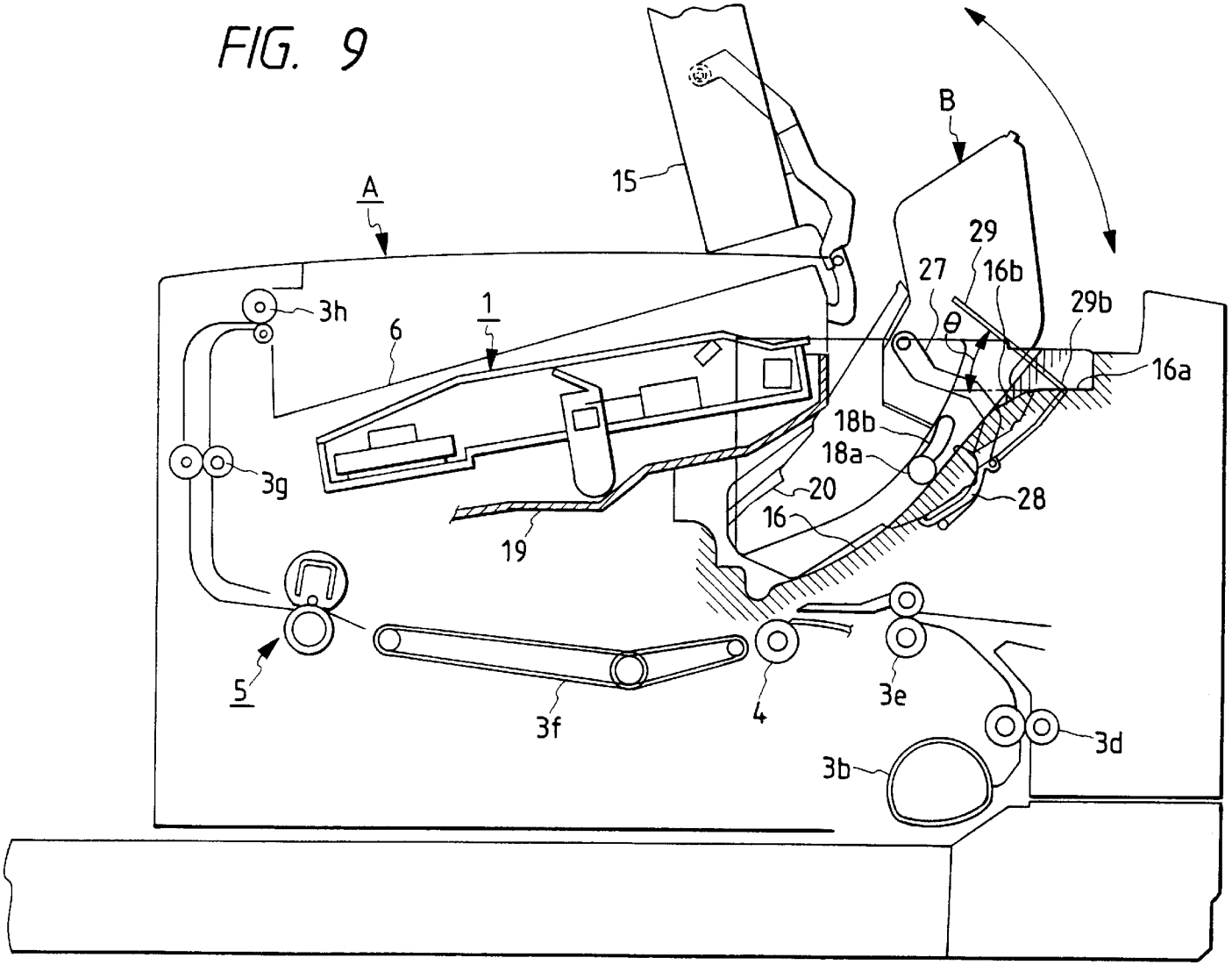
Figure 10:
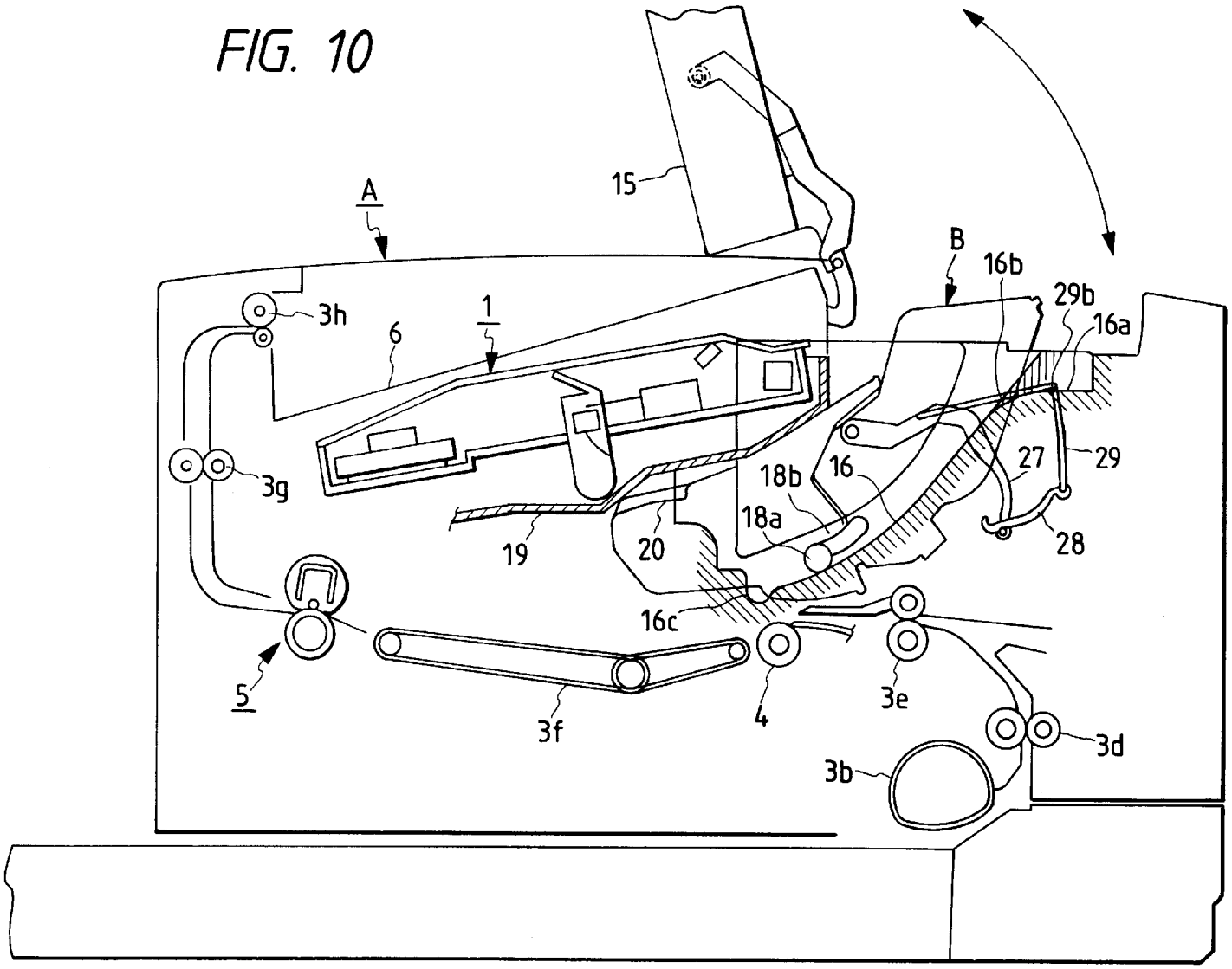
Figure 11:
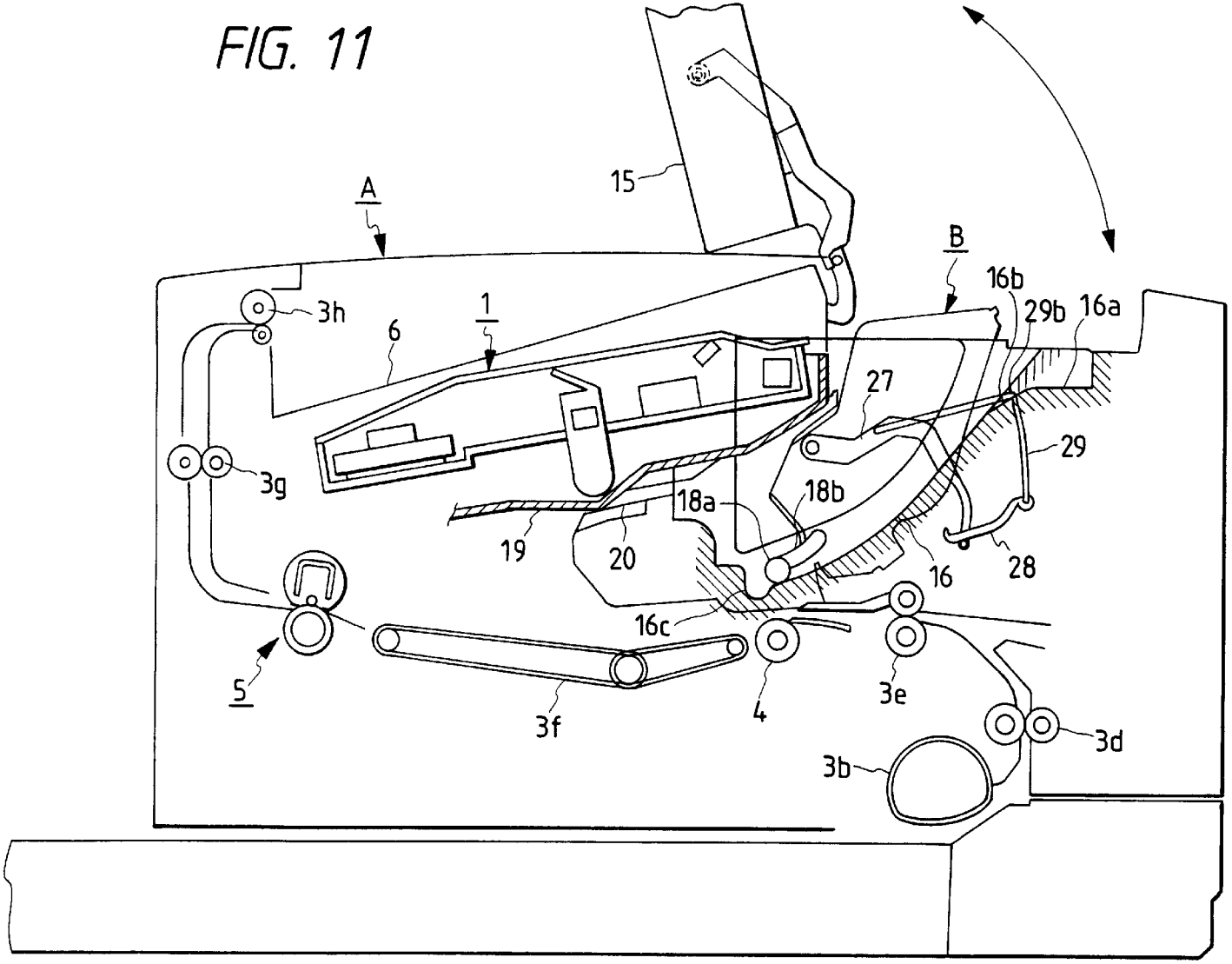
Figure 12:
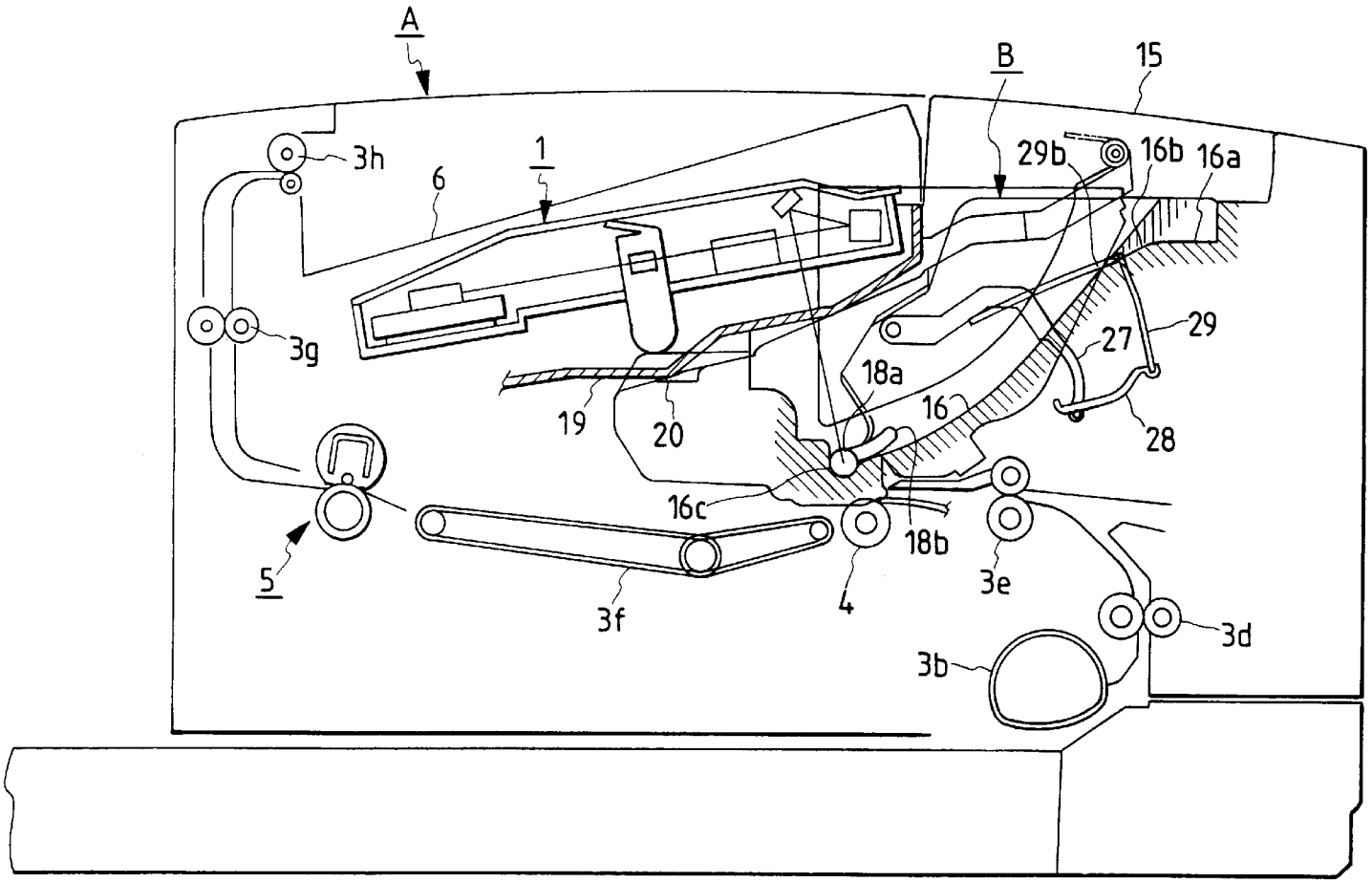

With the arrangement as mentioned above, when the process cartridge B is mounted, as shown in FIGS. 8 to 12, a forward end of the process cartridge is inserted below the optical system 1 of the image forming apparatus with guiding the bosses 18*a* and the ribs 18*b* along the guide rails 16. Since the guide rails 16 have the curved configurations and the guide members 17 (disposed above the guide rails) have a similar curved configurations and further the ribs 18*b* have the similar curved configurations, as the process cartridge is advanced in the inserting direction, the process cartridge B becomes horizontal. When the process cartridge B is further inserted, the posture of the process cartridge is changed gradually as shown in FIGS. 9 to 11, and then, as shown in FIG. 12, abutment surfaces 20 provided at both ends of the cleaning frame 13 abut against an abut member 19 of the main body 14 of the image forming apparatus, and then, the bosses 18*a* of the process cartridge B are received in receiving recesses 16*c* formed in end portions of the guide rails 16. Consequently, a drum gear (not shown) secured to one end of the photosensitive drum 7 is engaged by a drive gear 22 (FIG. 7) of the apparatus main body 14, so that a driving force can be transmitted to the process cartridge B.

Incidentally, the insertion of the protruded portions 29*b* of the link members 29 is regulated by the first and second inclined surfaces 16*a*, 16*b*, to thereby open the shutter 28.

When the process cartridge B includes the toner containing portion 10*a*, upper developing frame 12*a*, lower developing frame 12*b* and cleaning means 11 which contain the toner, if the process cartridge B rests on a desk or a floor in an upright condition for a long time, there is a danger of accumulating the toner at the bottom of the process cartridge. As a result, in spite of the fact that there are provided the toner feed members 10*b*1, 10*b*2, it takes a long time for making the toner uniform, so that the usage of the image forming apparatus is limited.

To avoid this, a grip portion 30 is formed horizontally on the toner containing portion 10*a* containing the toner along the longitudinal direction thereof. By providing the grip portion at this position, even when the operator carries about the process cartridge by gripping the grip portion by his hand, the cleaning means 11 is positioned at the bottom of the process cartridge and the toner containing portion 10*a* is positioned at the top of the process cartridge, since the grip portion 30 is gripped in parallel with the mounting and dismounting direction. Thus, the toner is prevented from accumulated at one side.

Figure 2:
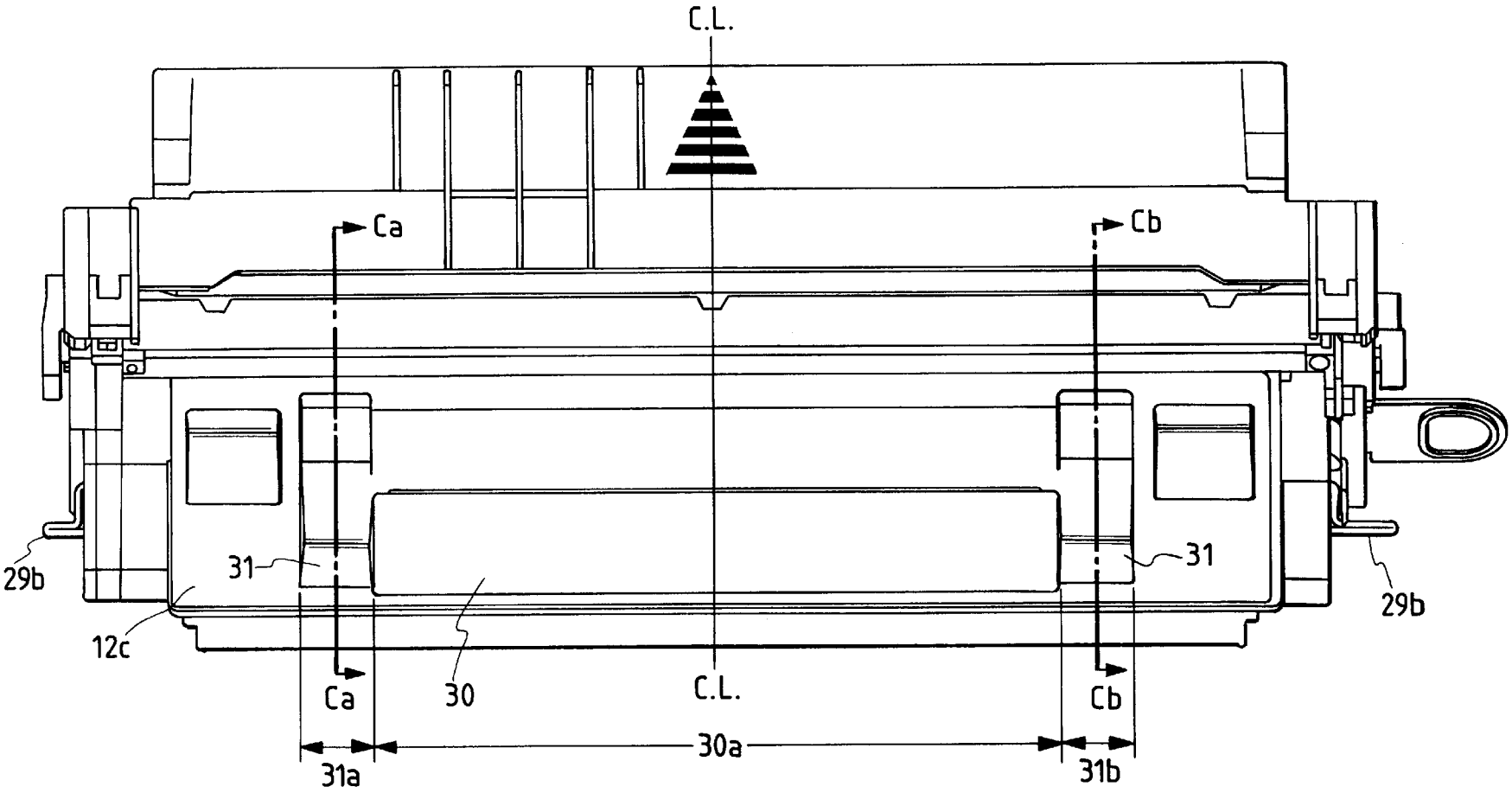
FIG. 2 is a plan view of the process cartridge according to the preferred embodiment.

When the process cartridge B is inserted into the main body 14 of the image forming apparatus, if the process cartridge B is inserted into the cartridge mounting portion while holding the process cartridge at one point near the longitudinal end thereof, the posture of the process cartridge to be inserted is inclined with respect to the main body 14 of the image forming apparatus, and a good mounting feeling cannot be obtained. To avoid this, as shown in FIG. 2, the grip portion 30 is provided line-symmetrically with respect to a gravity line C.L. crossed perpendicular to the longitudinal direction passing through a gravity center of the process cartridge, and an area (length) 30*a* of the grip portion is minimized in consideration of the size of the hand of the operator. As a result, the accumulation of the toner can be prevented and the posture of the process cartridge being inserted can be stabilized, since the operator can easily recognize the position of the grip portion 30 and grip the grip portion 30 positively for manipulation.

Figure 13:
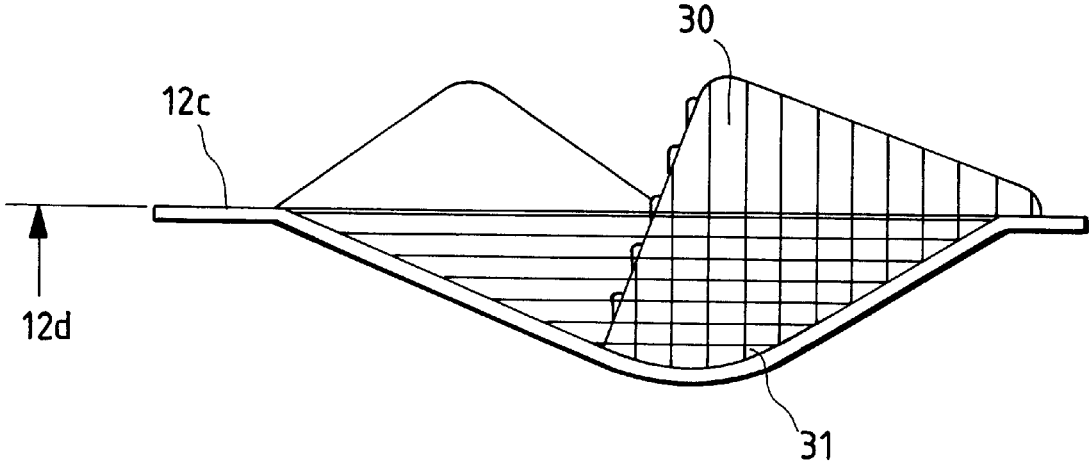
FIG. 13 is a sectional view showing a grip portion and a concave portion according to a first embodiment of the present invention.

Further, in the present invention, cavities (referred to as "concave portions" hereinafter) 31 are formed in both ends of the grip portion area 30*a* of the grip portion 30. As shown in FIG. 13 which is a sectional view taken along the line Ca—Ca in FIG. 2, each concave portion 31 is positioned below the grip portion 30 and a lid outer reference surface 12*d* of the lid member 12*c*. This is also true in the section taken along the line Cb—Cb in FIG. 2. Incidentally, in FIG. 13, in order to make clear a relation between the grip portion 30 and the concave portion 31, the area of the grip portion 30 is shown by the vertical lines and the area of the concave portion 31 is shown by the horizontal lines.

The lid outer reference surface 12*d* of the lid member 12*c* is an upper surface of a flange of the lid member 12*c* having a lower surface contacted with a flange surface 10*f* of a flange provided at an upper edge of the toner containing portion 10*a* and surrounding the toner containing portion. The operator can easily recognize the grip portion area 30*a* of the grip portion 30 due to the presence of the concave portions 31.

Further, if the operator grips areas out of the grip portion area 30*a* of the process cartridge B by his both hands, little fingers or little fingers and third fingers are contacted with the concave portions 31, since there are stepped portions between the grip portion 30 and the concave portions 31. In general, in the case where human being grips an object by his hand, when the object is gripped in a condition that four fingers other than the thumb are aligned in a line, the most effective force is applied and there is no bad feeling. Accordingly, when the little fingers or the little fingers and third fingers contact the concave portions 31 and index fingers and middle fingers contact the grip portion 30, the operator can grip the process cartridge within the grip portion area 30*a*, since it is difficult to hold and manipulate the process cartridge. It is important that the concave portions 31 are positioned below the lid outer reference surface 12*d*, since the greater the step between the grip portion and the concave portion, the worse the manipulating feeling.

(Second Embodiment)

In an image forming apparatus in which a color image can be formed, black toner, cyan toner, magenta toner and yellow toner are used, and a process cartridge (four process cartridges) for respective colors are used. If necessary, one of these four process cartridges may be mounted to the image forming apparatus or plural process cartridges may be mounted to the image forming apparatus.

Only alterations based on the difference in the features of four color toners are added to the respective process cartridges, and other common parts are used to design the process cartridges to have substantially the same outer configurations. In the case where four color process cartridges are used simultaneously, the respective process cartridges must be inserted into the correct positions.

Further, a derivative process cartridge and a derivative image forming apparatus are designed to improve the image quality or recording speed with respect to the existing process cartridge or image forming apparatus, and the existing articles and the derivative articles cannot be distinguished from each other at a glance, since various existing parts and units are used to form the derivative articles as they are. In the derivative articles, the process cartridge and the image forming apparatus are partially refined. Accordingly, although the derivative process cartridge can be used with an existing image forming apparatus, if an existing process cartridge is used with a derivative image forming apparatus, not only cannot improvement of the image quality be expected, but also, the service life of the internal parts are decreased, since the internal parts of existing process cartridges cannot accommodate high speed recording. In such a case, device non-exchangeability must be considered so that the derivative process cartridge can be used with both existing image forming apparatus and derivative image forming apparatus, but the existing process cartridge can be used with only the existing image forming apparatus.

To this end, when (all of or part of) process cartridges must have non-exchangeability, in the past, distinguishing labels have been adhered to the process cartridges to prevent the erroneous insertion. However, it is necessary that not only the labels but also physical non-exchangeability feature are provided.

Now, an example of the non-exchangeability will be explained.

Figure 14:
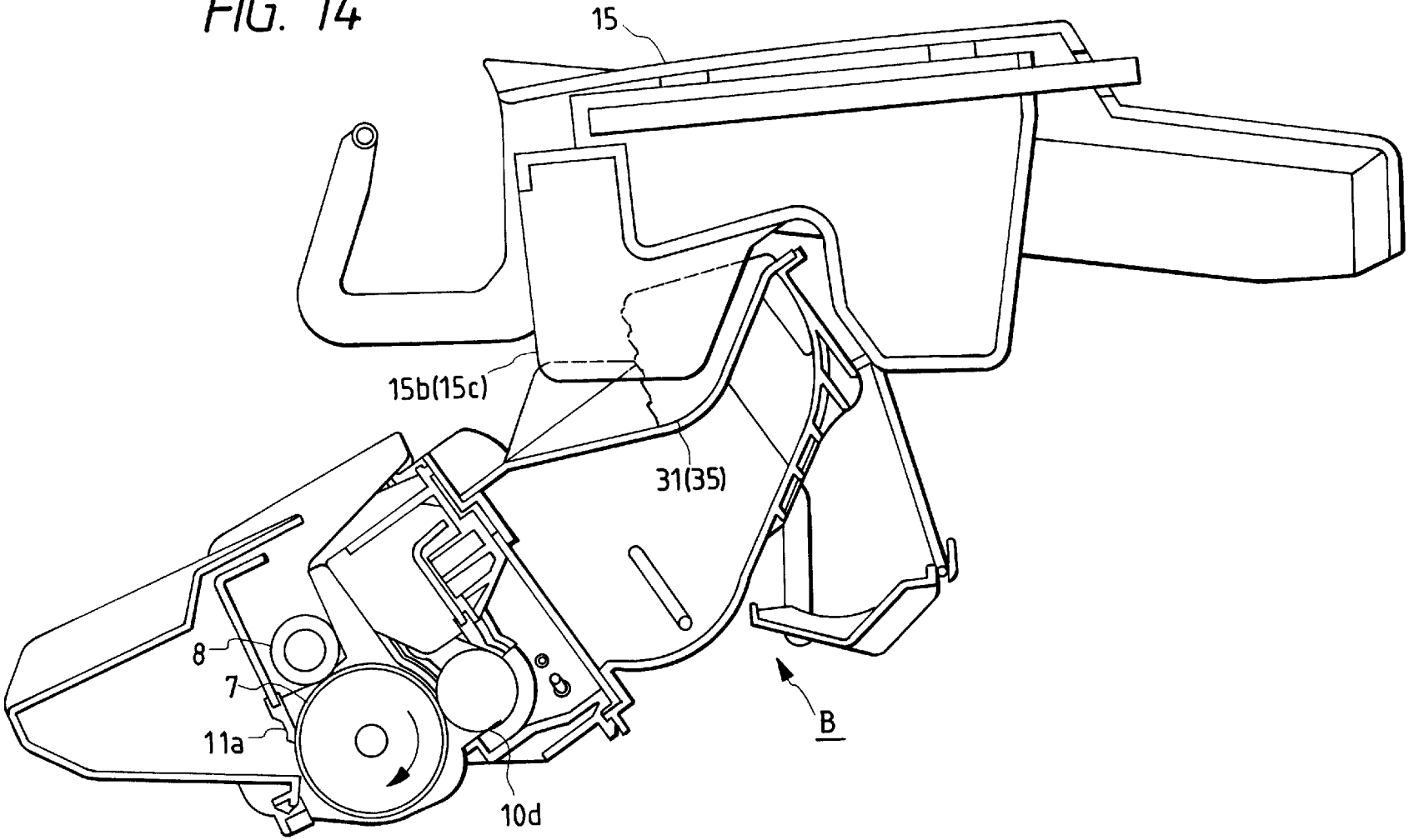
FIG. 14 is a sectional view taken along the line Ca—Ca or Cb—Cb in FIG. 2.

As shown in FIG. 3, convex portions 15*a* are provided on the open/close member 15 (or are formed integrally with the open/close member 15) forming a part of an outer surface of the image forming apparatus. And, as shown in FIG. 14, when the open/close member 15 is closed, the convex portions 15*b* are fitted into the concave portions 31 of the process cartridge B.

The combination of the existing process cartridge and image forming apparatus is referred to as "process cartridge B and image forming apparatus A" and the combination of the derivative process cartridge and image forming apparatus is referred to as "process cartridge D and image forming apparatus C".

Figure 15:
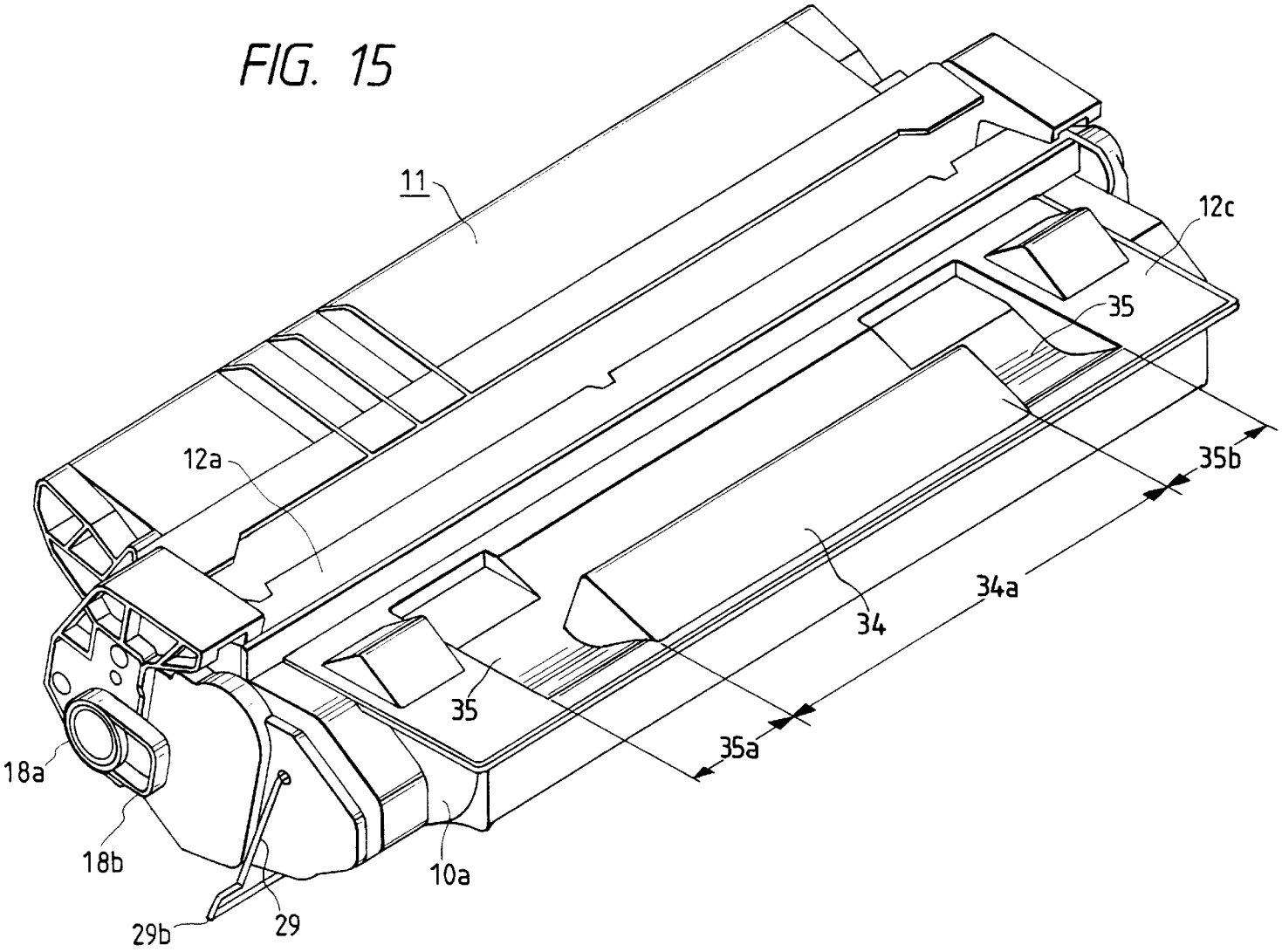
FIG. 15 is a perspective view showing a left side surface of a process cartridge according to a second embodiment of the present invention.

FIG. 15 is a perspective view of the process cartridge D. The changed points of the derivative process cartridge D are the longitudinal dimensions of a grip portion area 34*a* of a grip portion 34 and of areas 35*a*, 35*b* of concave portions 35 (the cross-sections of the concave portions 35 and the grip portion 34 are the same as those shown in FIG. 13). Similar to the image forming apparatus A, the derivative image forming apparatus C (not shown) has an open/close member 15 which is provided with convex portions 15*c* (see FIG. 3) (or the convex portions 15*c* are integrally formed with the open/close member 15). When the open/close member 15 is closed, as shown in FIG. 14, the convex portions 15*c* are fitted into the concave portions 35 of the derivative process cartridge D.

Figure 16:
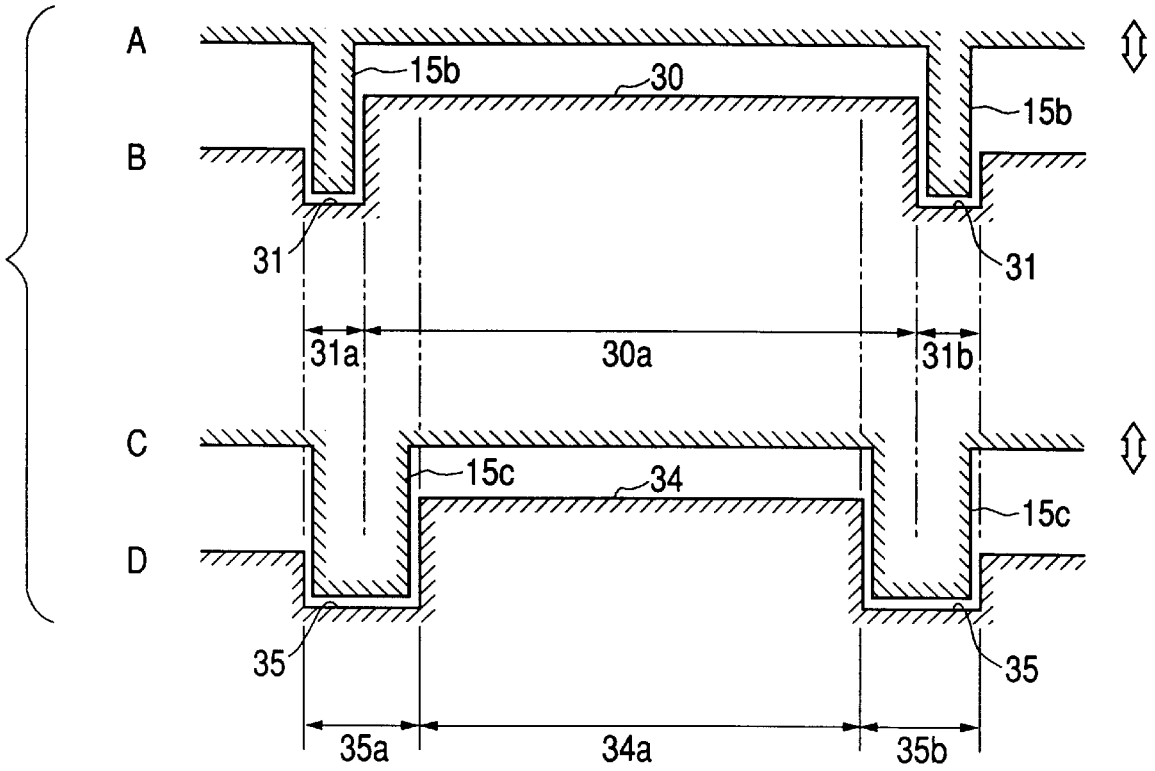
FIG. 16 is a schematic sectional view showing a dimensional relation between convex portions of an open/close member 15 of the image forming apparatus A, C and concave portions of the process cartridge B, D in a longitudinal direction.

FIG. 16 is a schematic sectional view showing the dimensional relation between the convex portion of the open/close members 15 of the image forming apparatuses A, C and the concave portions of the process cartridges B, D in the longitudinal direction.

As shown in FIG. 16, the grip portion area 30*a* of the process cartridge B is greater than the grip portion area 34*a* of the derivative process cartridge D, and sum of the concave portion areas 31*a*, 31*b* and the grip portion area 30*a* of the process cartridge B is equal to sum of the concave portion areas 35*a*, 35*b* and the grip portion area 34*a* of the derivative process cartridge D. And, the convex portions 15*b* of the open/close member 15 of the image forming apparatus A can just be fitted into the left and right concave portions 31 (having same width) of the process cartridge B so that the open/close member 15 can be closed completely. Further, the convex portions 15*c* of the open/close member 15 of the derivative image forming apparatus C can just be fitted into the left and right concave portions 35 (having same width) of the derivative process cartridge D so that the open/close member 15 can be closed completely.

In this way, regarding the longitudinal direction, both the existing process cartridge B and the derivative process cartridge D can be mounted within the cartridge mounting portions of the image forming apparatuses A, C, and longitudinal positions of the concave portions 31, 35 are the same. In the illustrated embodiment, widths of the concave portions 31 of the existing process cartridge B are smaller than widths of the concave portions 35 of the derivative process cartridge D. With this arrangement, as shown in FIG. 16, the image forming apparatus A and the process cartridge B, and the image forming apparatus C and the process cartridge D are combined. In this case, the convex portions 15*b*, 15*c* of the open/close members 15 are fitted into the concave portions 31, 35 at the concave portion areas 31*a*, 31*b* and 35*a*, 35*b* of the lid members 12*c*, so that the open/close members 15 can be closed completely.

Figure 17:
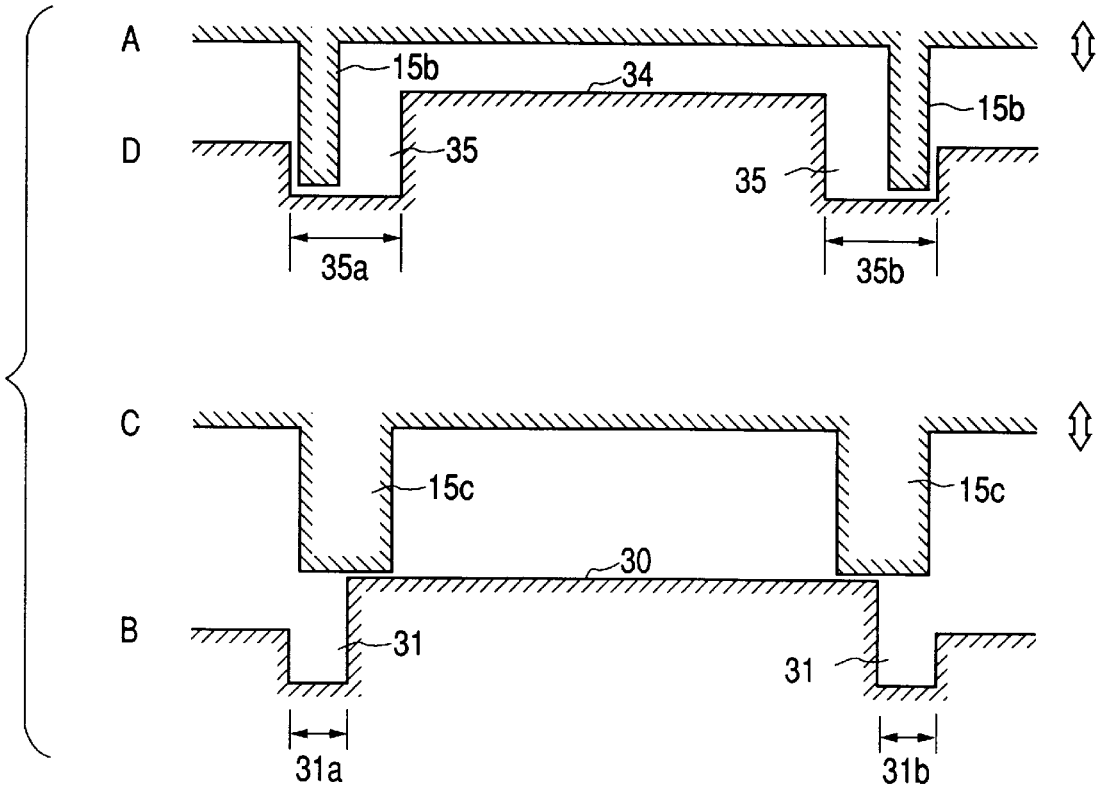
FIG. 17 is a schematic sectional view showing a dimensional relation between the convex portions of the open/close member 15 and the concave portions in the longitudinal direction when the combination of the image forming apparatus A, C and the process cartridge B, D is changed.

However, when the process cartridges B, D are exchanged to change the combination, as shown in FIG. 17, in a combination of the image forming apparatus A and the process cartridge D, the convex portions 15*b* of the open/close member 15 are fitted into the concave portions 35 at the concave portion areas 35*a*, 35*b* of the lid member 12*c*, so that the open/close member 15 can be closed completely. To the contrary, in a combination of the image forming apparatus C and the process cartridge B, the longitudinal dimension of the convex portions 15*c* of the open/close member 15 of the derivative image forming apparatus C is greater than that of the concave portion areas 31*a*, 31*b* of the lid member 12*c* of the existing process cartridge B. Thus, even when the open/close member 15 of the derivative image forming apparatus C is closed, the convex portions 15*c* of the open/close member 15 abut against the grip portion 30 of the lid member 12*c* of the existing process cartridge B, so that the open/close member 15 cannot be closed completely.

Such results are shown in a logic table shown in FIG. 18. From such results, it is apparent that, although the derivative process cartridge D can be used with both the image forming apparatuses A and C, the existing process cartridge B cannot be used with the derivative (high version) image forming apparatus C, so that the exchangeability to the high version can be achieved.

Figure 19:
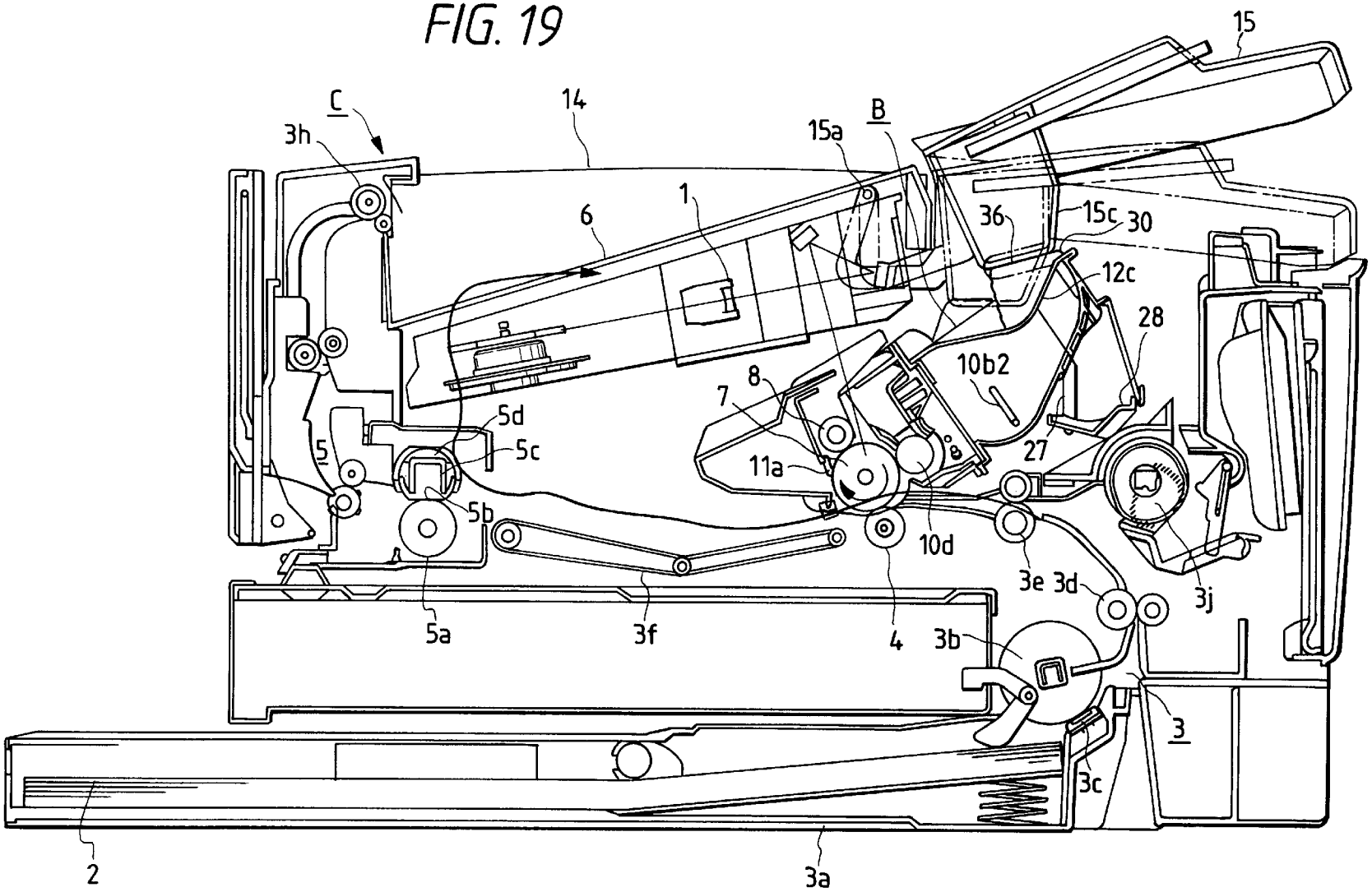
FIG. 19 is an elevational sectional view showing a condition that the open/close member of the image forming apparatus cannot be completely closed if the process cartridge is erroneously inserted.

FIG. 19 shows the condition that the open/close member 15 cannot be closed completely. In this condition, the convex portions 15*c* of the open/close member 15 of the derivative image forming apparatus C abut against the grip portion 30 of the lid member 12*c* of the existing process cartridge B at abut points 36, so that a free end of the open/close member 15 is floating to some extent. The main body 14 of the image forming apparatus has a switch which can be operated when the open/close member 15 is closed completely, and, when the switch is operated, image formation is permitted. The main body 14 of the image forming apparatus detects the condition that the open/close member 15 is not closed completely to thereby prohibit image formation. Further, the erroneous insertion of the process cartridge can be recognized, since the operation can clearly recognize the condition that the open/close member 15 is not closed completely.

(Third Embodiment)

Figure 20:
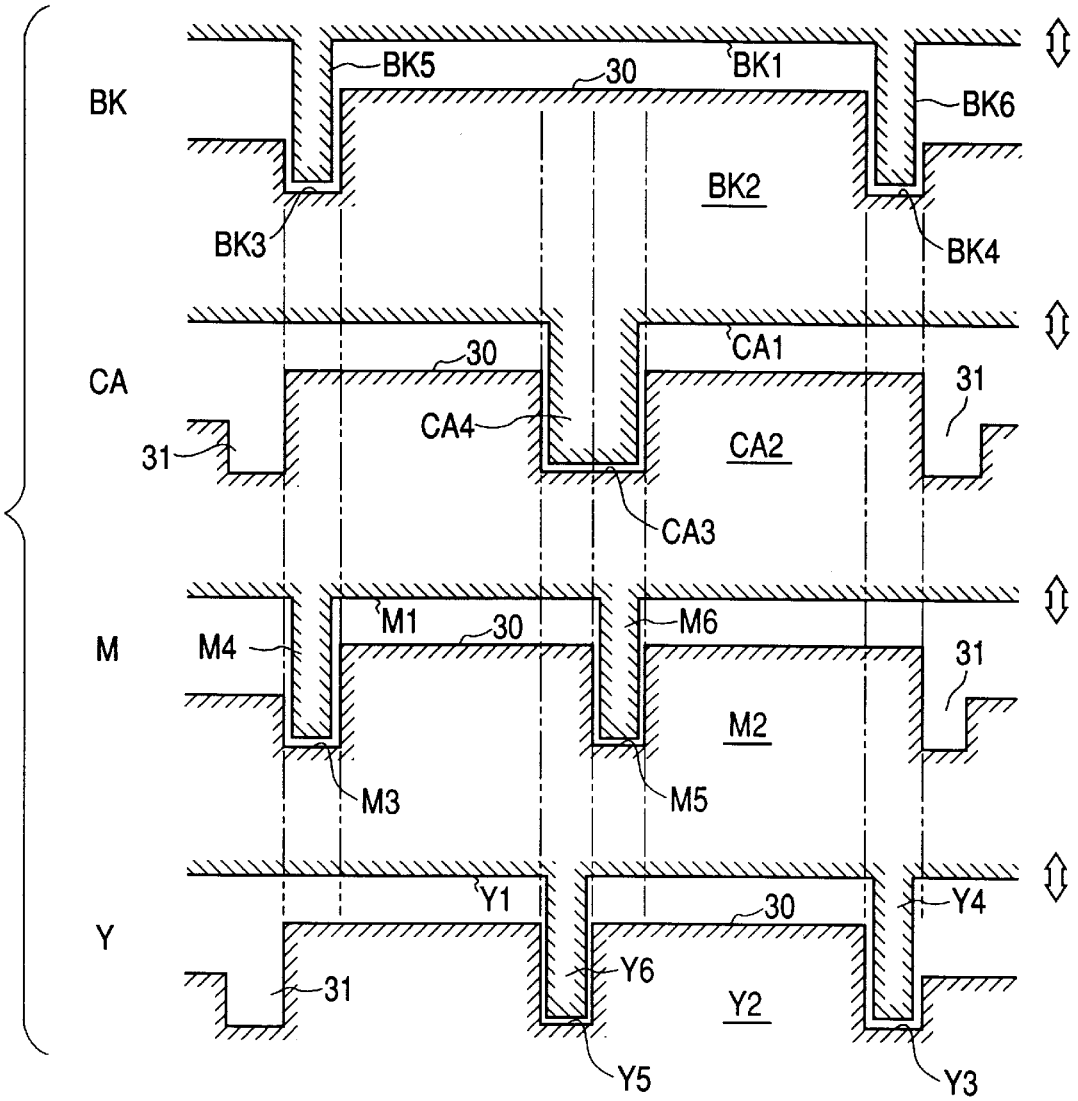
FIG. 20 is a schematic sectional view showing a dimensional relation between four kinds (for black, cyan, magenta and yellow) of convex portions of the open/close member and four kinds of concave portions of the process cartridge in a longitudinal direction.

In order to achieve the complete non-exchangeability of the four color process cartridges, when the combinations and the positions of the convex portions and the concave portions are selected as shown in FIG. 20, as is apparent from the results shown in FIG. 21, the complete non-exchangeability of the four color (black, cyan, magenta and yellow) process cartridges can be achieved.

That is to say, in FIG. 20, an open/close member BK1 of a black image forming apparatus using black toner BK is provided with convex portions BK5, BK6 which can be just fitted into recessed BK3, BK4 of a black process cartridge BK2 containing the black toner BK to permit the complete closing of the open/close member BK1.

A cyan process cartridge CA2 containing cyan toner CA is provided with a recess CA3 having a width (in the longitudinal direction of the cyan process cartridge CA2) greater than those of the other recesses and disposed at a position corresponding to the middle between the recesses BK3 and BK4 of the black process cartridge BK2 containing the black toner BK. An open/close member CA1 of a cyan image forming apparatus using the cyan toner CA is provided with a convex portion CA4 which can be just fitted into the recess CA3 to permit the complete closing of the open/close member CA1. Concave portions 31 are provided on both longitudinal ends of a grip portion 30 of the cyan process cartridge CA2 at positions corresponding to positions adjacent (from outside) to the recesses BK3, BK4 of the black process cartridge BK2 containing the black toner BK. The concave portions 31 serve to cause the operator to grip the grip portion correctly.

An open/close member M1 of a magenta image forming apparatus using magenta toner M is provided with a convex portion M4 disposed at a position corresponding to the recess BK3 of the black process cartridge BK2 containing the black toner BK. The convex portion M4 can be just fitted into a recess M3 of a process cartridge M2 containing the magenta toner M. The recesses BK3, M3 have the same width in the longitudinal direction.

Further, the magenta process cartridge M2 containing the magenta toner is provided with a recess M5 disposed at a position corresponding to the half of the recess CA3 (FIG. 20) of the cyan process cartridge CA2. And, the open/close member M1 of the magenta image forming apparatus is provided with a convex portion M6 which can just be fitted into the recess M5. When the magenta process cartridge M2 is inserted into the magenta image forming apparatus and the open/close member M1 is closed, the convex portions M4, M6 are fitted into the recesses M3, M5 of the magenta process cartridge M2, respectively to thereby permit the complete closing of the open/close member M1.

Incidentally, the process cartridge M2 containing the magenta toner is provided with a concave portion 31 disposed at the right side of a grip portion 30 at a position corresponding to the position of the right concave portion 31 of the cyan process cartridge CA2. This concave portion 31 also serves to cause the operator to grip the grip portion 30 correctly.

An open/close member M1 of a yellow image forming apparatus using yellow toner Y is provided with a convex portion Y4 disposed at a position corresponding to the recess BK4 of the black process cartridge BK2 containing the black toner BK. The convex portion Y4 can be just fitted into a recess Y3 of a process cartridge Y2 containing the yellow toner. The recesses BK4, Y3 have the same width in the longitudinal direction.

The yellow process cartridge Y2 is provided with a recess Y5 disposed at a position corresponding to the half of the recess CA3 (FIG. 20) of the cyan process cartridge CA2. And, the open/close member Y1 of the yellow image forming apparatus is provided with a convex portion Y6 which can just be fitted into the recess Y5. When the yellow process cartridge Y2 is inserted into the magenta image forming apparatus and the open/close member Y1 is closed, the convex portions Y4, Y6 are fitted into the recesses Y3, Y5 of the yellow process cartridge Y2, respectively to thereby permit the complete closing of the open/close member Y1.

Incidentally, the process cartridge Y2 containing the yellow toner is provided with a concave portion 31 disposed at the left side of a grip portion 30 which also serves to cause the operator to grip the grip portion 30 correctly.

When any process cartridge CA2, M2 and Y2 other than the process cartridge BK2 containing the black toner is inserted into the image forming apparatus for forming the black toner image, although such a process cartridge can be mounted to the image forming apparatus, the open/close member BK1 cannot be closed completely. That is to say, at least one of the convex portions BK5, BK6 of the open/close member BK1 abut against both ends of the grip portion 30 of the cyan process cartridge CA2 or the right end of the grip portion 30 of the magenta process cartridge M2 or the left end of the grip portion 30 of the yellow process cartridge Y2.

When any process cartridge BK2, M2 or Y2 other than the process cartridge CA2 containing the cyan toner is inserted into the image forming apparatus for forming the cyan toner image, although such a process cartridge can be mounted to the image forming apparatus, the open/close member CA1 cannot be closed completely. That is to say, although the process cartridge BK2, M2 and Y2 can be inserted into the cartridge mounting portion of the image forming apparatus for forming the cyan toner image, the convex portion CA4 of the open/close member CA1 abut against the central portion of the grip portion 30 of the process cartridge BK2, M2 or Y2 to thereby prevent the complete closing of the open/close member CA1.

When any process cartridge BK2, CA2 and Y2 other than the process cartridge M2 containing the magenta toner is inserted into the image forming apparatus for forming the magenta toner image, although such a process cartridge can be mounted to the image forming apparatus, the open/close member M1 cannot be closed completely. That is to say, the convex portion M6 of the open/close member M1 abuts against the central portion of the grip portion 30 of the process cartridge BK2 or Y2. And, the convex portion M4 of the open/close member M1 abuts against the left end of the grip portion 30 of the process cartridge CA2.

When any process cartridge BK2, CA2 or M2 other than the process cartridge Y2 containing the yellow toner is inserted into the image forming apparatus for forming the magenta toner image, although such a process cartridge can be mounted to the image forming apparatus, the open/close member Y1 cannot be closed completely. That is to say, the convex portion Y6 of the open/close member Y1 abuts against the central portion of the grip portion 30 of the process cartridge BK2 or M2. And, the convex portion Y4 of the open/close member Y1 abuts against the right end of the grip portion 30 of the process cartridge CA2.

Of course, the members disposed on both sides of the grip portions 30 in the longitudinal direction, such as the recesses BK3, BK4, M4 and Y4, have the same functions as the concave portions 31 and serve to recognize the gripping of the central portion (in the longitudinal direction) of the grip portion 30 of the process cartridge BK2, M2 or Y2.

In a full-color image forming apparatus in which process cartridges for effecting multi-color development are arranged side by side, it is preferable that the open/close members BK1, CA1, M1 and Y1 are integrally formed with each other in a side-by-side relation (Of course, although these open/close members may be formed independently, the number of open/close members is increased. By detachably mounting the process cartridges BK2, CA2, M2 and Y2, the mounting and dismounting of the process cartridges in the full-color image forming apparatus can be effected without mistaking the color.

As mentioned above, according to the present invention, the grip portion area of the grip portion can easily be recognized, since there are provided the concave portions. Further, the grip portion area can surely be gripped by the operator, since, if the operator grips the concave portion, an undesirable feeling is obtained. By surely manipulating the process cartridge by gripping the grip portion, the toner can be prevented from being accumulated in the local position and the inserting posture of the process cartridge can be stabilized.

By combining the recesses of the process cartridge and the convex portions of the image forming apparatus, non-exchangeability can be achieved. If the erroneous combination is used, the convex portion(s) of the open/close member abut(s) against the grip portion of the process cartridge at the abut point(s), so that the open/close member cannot be closed completely to thereby prohibit image formation. Further, the erroneous insertion of the process cartridge can be recognized, since the operator can recognize the fact that the open/close member is not closed completely.

What is claimed is:

1. A process cartridge detachably mountable to a main body of an electrophotographic image forming apparatus, comprising:

(a) an electrophotographic photosensitive member;

(b) process means acting on said electrophotographic photosensitive member;

(c) a cartridge frame;

(d) a grip portion to be gripped when the process cartridge is mounted to and dismounted from the main body of the electrophotographic image forming apparatus;

(e) a first concave portion provided on said cartridge frame at one side of said grip portion in a longitudinal direction of said cartridge frame and being concave toward the interior of the process cartridge; and (f) a second concave portion provided on said cartridge frame at the other side of said grip portion opposite to said one side in the longitudinal direction of said cartridge frame and being concave toward the interior of the process cartridge.

2. A process cartridge according to claim 1, wherein said grip portion protrudes outwardly from the process cartridge.

3. A process cartridge according to claim 2, wherein said process means includes a developing member for developing a latent image formed on said electrophotographic photosensitive member, and said cartridge frame has a developer containing frame for containing developer to be supplied to said developing member, and said grip portion, said first concave portion, and said second concave portion are provided on said developer containing frame.

4. A process cartridge according to claim 2, wherein said process means includes a cleaning member for removing residual developer remaining on said electrophotographic photosensitive member, wherein said cartridge frame has a waste developer containing frame for containing the developer removed from said electrophotographic photosensitive member by said cleaning member, and said grip portion, said first concave portion, and said second concave portion are provided on said waste developer containing frame.

5. A process cartridge according to claim 3, wherein said developer containing frame incudes an upper frame positioned at an upper part of the process cartridge when the process cartridge is mounted to said main body of said image forming apparatus, and a lower frame positioned at a lower part of the process cartridge when the process cartridge is mounted to the main body of the image forming apparatus, and said grip portion, said first concave portion, and said second concave portion are provided on said upper frame.

6. A process cartridge according to claim 5, wherein, when the process cartridge is mounted to the main body of the image forming apparatus, said grip portion, said first concave portion, and said second concave portion are positioned above the developer contained in said developer containing frame.

7. A process cartridge according to claim 5 or 6, wherein said upper frame, said grip portion, said first concave portion, and said second concave portion are integrally molded from plastic material.

8. A process cartridge according to claim 7, wherein the main body of said image forming apparatus includes an open/close cover, and when said cover is closed after the process cartridge is mounted to the main body of the image forming apparatus by gripping said grip portion, a first convex portion and a second convex portion formed on an inner surface of said cover are inserted into said first and second concave portions, respectively.

9. A process cartridge according to claim 1, wherein the process cartridge incorporates therein said electrophotographic photosensitive member, and at least one of a charge member for charging said electrophotographic photosensitive member, a developing member for developing a latent image formed on said electrophotographic photosensitive member, and a cleaning member for removing residual developer remaining on said electrophotographic photosensitive member which acts as said process means, as a cartridge unit which can detachably be mounted to the main body of the image forming apparatus.

10. A process cartridge detachably mountable to an electrophotographic image forming apparatus having an open/close cover, and a first convex portion and a second convex portion formed on an inner surface of said cover, said process cartridge comprising:

(a) an electrophotographic photosensitive member;

(b) process means acting on said electrophotographic photosensitive member;

(c) a cartridge frame;

(d) a grip portion to be gripped when the process cartridge is mounted to and dismounted from a main body of the electrophotographic image forming apparatus;

(e) a first concave portion provided on said cartridge frame at one side of said grip portion in a longitudinal direction of said cartridge frame and being concave toward the interior of the process cartridge, said first concave portion being inserted into said first convex portion when said cover is closed after the process cartridge is mounted to the main body of the image forming apparatus by gripping said grip portion; and (f) a second concave portion provided on said cartridge frame at the other side of said grip portion opposite to said one side in the longitudinal direction of said cartridge frame and being concave toward the interior of the process cartridge, said second concave portion being inserted into said second convex portion when said cover is closed after the process cartridge is mounted to the main body of the image forming apparatus by gripping said grip portion.

11. A process cartridge according to claim 10, wherein said grip portion protrudes outwardly from the process cartridge.

12. A process cartridge according to claim 11, wherein said process means includes a developing member for developing a latent image formed on said electrophotographic photosensitive member, and said cartridge frame has a developer containing frame for containing developer to be supplied to said developing member, and said grip portion, said first concave portion, and said second concave portion are provided on said developer containing frame.

13. A process cartridge according to claim 11, wherein said process means includes a cleaning member for removing residual developer remaining on said electrophotographic photosensitive member, wherein said cartridge frame has a waste developer containing frame for containing the developer removed from said electrophotographic photosensitive member by said cleaning member, and said grip portion, said first concave portion and said second concave portion are provided on said waste developer containing frame.

14. A process cartridge according to claim 12, wherein said developer containing frame includes an upper frame positioned at an upper part of the process cartridge when the process cartridge is mounted to the main body of the image forming apparatus, and a lower frame positioned at a lower part of the process cartridge when the process cartridge is mounted to the main body of the image forming apparatus, and said grip portion, said first concave portion, and said second concave portion are provided on said upper frame.

15. A process cartridge according to claim 14, wherein, when the process cartridge is mounted to the main body of the image forming apparatus, wherein said grip portion, said first concave portion, and said second concave portion are positioned above the developer contained in said developer containing frame.

16. A process cartridge according to claim 14 or 15, wherein said upper frame, said grip portion, said first concave portion, and said second concave portion are integrally molded from plastic material.

17. A process cartridge according to claim 10, wherein the process cartridge incorporates therein said electrophotographic photosensitive member, and at least one of a charge member for charging said electrophotographic photosensitive member, a developing member for developing a latent image formed on said electrophotographic photosensitive member, and a cleaning member for removing residual developer remaining on said electrophotographic photosensitive member which acts as said process means, as a cartridge unit which can detachably be mounted to the main body of the image forming apparatus.

18. An image forming apparatus on which a process cartridge is detachably mounted, comprising:

(a) mount means for mounting a process cartridge including an electrophotographic photosensitive member, process means acting on said electrophotographic photosensitive member, a cartridge frame, a grip portion to be gripped when the process cartridge is mounted to and dismounted from a main body of said image forming apparatus, a first concave portion provided on said cartridge frame at one side of said grip portion in a longitudinal direction of said cartridge frame and being concave toward the interior of the process cartridge, and a second concave portion provided on said cartridge frame at the other side of said grip portion opposite to said one side in the longitudinal direction of said cartridge frame and being concave toward the interior of the process cartridge; and (b) an open/close cover having a first convex portion and a second convex portion on an inner surface thereof, wherein upon mounting said process cartridge on the main body by said mount means, said grip portion is gripped after said cover is opened and upon closing said cover the first and second convex portions are respectively inserted into the first and second concave portions.

* * * * *

UNITED STATES PATENT AND TRADEMARK OFFICE

CERTIFICATE OF CORRECTION

PATENT NO. : 5,911,096

DATED : June 8, 1999

INVENTOR(S) : YOSHIYUKI BATORI, ET AL.

It is certified that error appears in the above-identified patent and that said Letters Patent is hereby corrected as shown below:

COLUMN 1:
Line 29, "printers" should read --printer--.

COLUMN 3:
Line 40, "regist" should read --register--.

COLUMN 4:
Line 60, "provided" should read --engages--.

COLUMN 5:
Line 19, "a" should be deleted.
Line 57, "accumulated" should read --accumulating--.

COLUMN 7:
Line 8, "are" should read --is--.

COLUMN 9:
Line 8, "recessed" should read --recesses--.

UNITED STATES PATENT AND TRADEMARK OFFICE

CERTIFICATE OF CORRECTION

PATENT NO. : 5,911,096

DATED : June 8, 1999

INVENTOR(S) : YOSHIYUKI BATORI, ET AL.

It is certified that error appears in the above-identified patent and that said Letters Patent is hereby corrected as shown below:

COLUMN 13:

Line 30, delete "wherein".

Signed and Sealed this

Sixth Day of June, 2000

*Attest:*

Q. TODD DICKINSON

*Attesting Officer*

*Director of Patents and Trademarks*